United States Patent [19]

Yinko, Sr.

[11] Patent Number: 4,637,593

[45] Date of Patent: Jan. 20, 1987

[54] LADLE CUP FOR POURING MOLTEN METAL

[76] Inventor: Richard H. Yinko, Sr., 1377 Kings Ct., Sheboygan, Wis. 53081

[21] Appl. No.: 764,103

[22] Filed: Aug. 9, 1985

[51] Int. Cl.[4] ..... C21B 3/00

[52] U.S. Cl. ..... 266/275; 266/286

[58] Field of Search ..... 266/275, 280, 44, 286, 266/278, 193

[56] References Cited

U.S. PATENT DOCUMENTS

| | | | |
|---|---|---|---|
| 781,293 | 1/1905 | McDonald | 266/275 |
| 3,386,720 | 6/1968 | Fritz | 266/286 |
| 3,800,014 | 3/1974 | Brichard | 266/286 |
| 4,330,107 | 5/1982 | Lynham | 266/44 |

FOREIGN PATENT DOCUMENTS

| | | | |
|---|---|---|---|
| 0393037 | 12/1973 | U.S.S.R. | 266/275 |

*Primary Examiner*—L. Dewayne Rutledge
*Assistant Examiner*—S. Kastler
*Attorney, Agent, or Firm*—Silverman, Cass, Singer & Winburn, Ltd.

[57] ABSTRACT

A ladle for transporting and pouring molten metal includes a pair of nested shells which are separated by a heat-insulating layer of refractory material. Heat exchange or venting conduit means communicate between the refractory layer and ambient atmosphere to dissipate heat conducted to the refractory layer from the molten metal through the walls of the shells whereby to prolong the useful life of the shells.

10 Claims, 3 Drawing Figures

LADLE CUP FOR POURING MOLTEN METAL

BACKGROUND OF THE INVENTION

This invention relates to ladles for pouring molten metal in metal casting operations.

In the die cast industry, ladle cups are employed for transferring and pouring molten metal. These ladles deteriorate with prolonged use due to chemical and thermal stresses produced thereon by the high temperature of the molten metal which rapidly burns holes in the ladle walls. Even with routine maintenance, conventional ladles have a relatively short useful life such that frequent repair and/or replacement thereof can be very expensive.

Furnaces for melting metal and containers for molten glass have employed high-temperature resistant refractory materials as described, for example, in U.S. Pat. Nos. 3,916,047 and 2,947,114. In efforts to prolong the useful life of a ladle for pouring molten metal, it has been known to use a lining of refractory materials, such as described in U.S. Pat. Nos. 4,330,107 and 2,967,339.

However, it is known that use of a refractory lining in these ladles is not adequate because the lining is eroded as a result of repeated charging and pouring of the molten metal. U.S. Pat. No. 4,330,107 describes a ladle in which the interior refractory lining is fabricated as a sleeve which must be periodically replaced; further such a sleeve device requires special retaining clips or rods to hold the lining sleeve in place, particularly when the ladle is tilted. The primary disadvantages of short life for the prior art ladle structures, including special clips or other retainer devices are eliminated by the herein invention.

SUMMARY OF THE INVENTION

A pouring ladle for molten metal which comprises, a pair of cup-shaped shells of complementary configuration nested to provide spaced apart interior and exterior wall surfaces of the ladle. The shells sandwich therebetween a configured layer of high-temperature resistant refractory material. Heat venting means communicating between the refractory layer and ambient atmosphere accelerated heat exchange between molten metal in the ladle, the ladle walls in contact with the molten metal and ambient atmosphere whereby to decrease adverse effects on the ladle's wall surface.

In the preferred embodiment, a plurality of venting tubes open at the upper ends thereof projecting above the shells. The tubes extend into the refractory layer between the shells. Thus, either shell can be repaired, when necessary, merely by applying a simple metallic patch to cover rupture therein. The vented, refractory insulating layer is preserved and hardened with repeated use of the ladle so that even if a rupture develops in one of the shells, leakage of molten metal from the ladle will be prevented until the repair can be made.

DESCRIPTION OF THE PREFERRED EMBODIMENT

Figure 1:
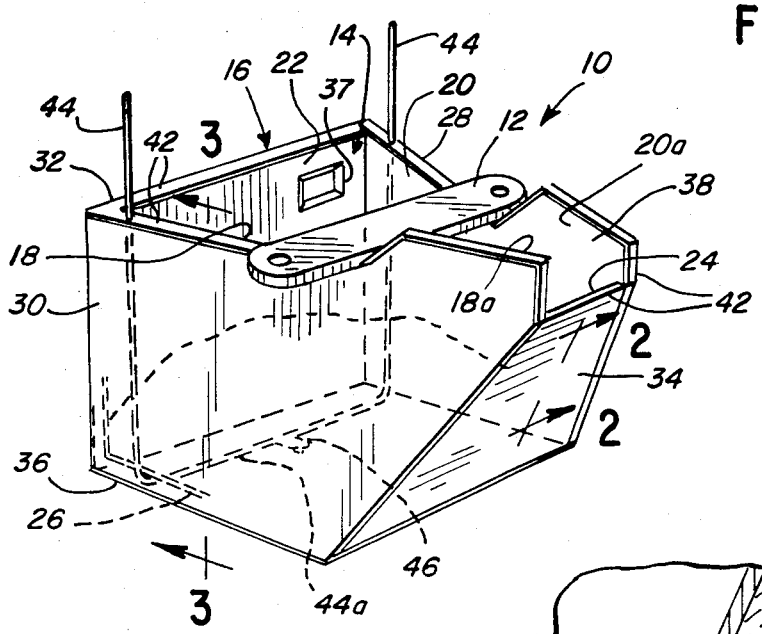
FIG. 1 is a perspective view of a pouring ladle for molten metal embodying the invention.

Referring to FIG. 1, a ladle embodying the invention is designated generally by a reference character 10. The ladle 10 includes a mounting bracket 12 for mounting the ladle 10 on a typical automatic ladler (not shown) which will dip the ladle 10 into a bath of molten metal and then, transfer and tilt the filled ladle 10 to pour the molten metal into a casting mold (not shown). The bracket 12 can be assembled to the ladle 10 at various locations suitable for mounting the ladle 10 on an automatic ladler. Alternatively, the bracket 12 can be adapted for manual filling and pouring operations. The exact configuration for such a bracket can vary within wide limits suitable for its intended function.

The ladle 10 includes a pair of generally congruent stainless steel shells, each shell being designated generally by reference characters 14 and 16, respectively. The shells 14 and 16 form the respective interior and exterior retainer wall surfaces of the ladle 10. Each of the shells 14 and 16 is shown as including five planar wall sections welded together to provide an open top. The interior shell 14 includes a pair of opposing side walls 18 and 20 and opposing rear and front walls 22 and 24 upstanding from a bottom wall 26. The exterior shell 16 includes corresponding side walls 28 and 30, and rear and front walls 32 and 34 upstanding from a bottom wall 36. A rectangular passageway 37 through the rear walls 22 and 32 provides for entry and self-skimming of molten metal when the rear of the ladle is tipped into the metal bath in a conventional manner.

The front walls 24 and 34 are outwardly inclined. Ladle 10 is tapered toward the front walls 24 and 34 to provide a spout opening 38 from which the molten metal is poured. Opening 38 is defined between forward portions 18*a* and 20*a* of the respective sidewalls 18 and 20 which extend above the front walls 24 and 34. Although ladle 10 has been illustrated as having generally a tapered, rectangular configuration, it will be appreciated that ladle 10 can be fabricated in various alternative configurations, for example, having generally cylindrical interior and exterior shells. Each shell can be fabricated by bending or punch-pressing a single piece of metal.

The walls of the respective shells 14 and 16 are preferably 11 guage stainless steel approximately ⅛ inch thick. Other suitable materials, for example ceramic, can be used for either of the shells 14 and 16, governed by suitability for contact with the molten metal transferred in the ladle.

Figure 2:
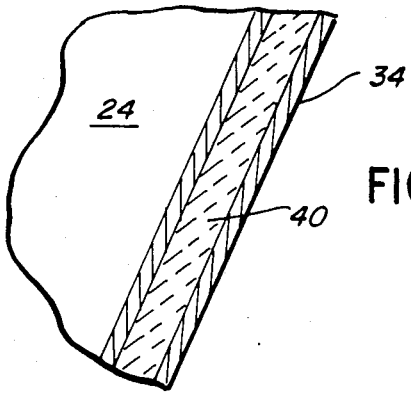
FIG. 2 is a fragmentary, sectional view taken along line 2—2 of FIG. 1 to illustrate the insulating refractory layer separating interior and exterior metal shells of the ladle.

Referring to FIG. 2, the shells 14 and 16 are separated by a high-temperature resistant layer 40 of the refractory material which provides a heat insulator between the two shells, as particularly shown between the respective front walls 24 and 34. The layer 40 can be approximately ½ inch thick, for example, when the capacity of the ladle is in the range of approximately 10 to 15 pounds of molten metal. While any conventional high-temperature refractory material such as silicas and aluminas can be employed for the layer 40, a preferred refractory material is fibrous alumino-silicate, which is commercially available from Refractory Products, Inc., of Elgin, Ill. under the trade name FIBERFRAX in grades RPC-X and RPC-X-AQ.

Figure 3:
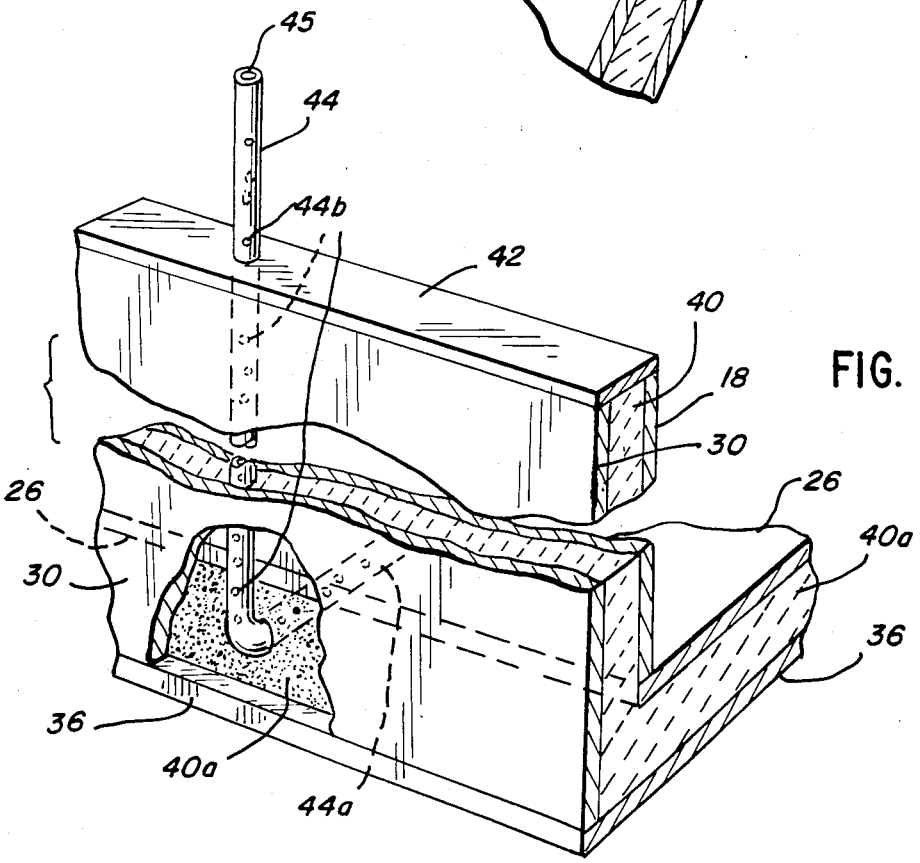
FIG. 3 is a fragmentary sectional view taken along line 3—3 of FIG. 1 to illustrate a heat venting tube embedded in the refractory layer and projecting above the shells.

Referring to FIG. 3, the refractory layer 40 extends between the shells 14 and 16, including between the bottom walls 26 and 36. Stainless steel strips 42 are welded to join the upper edges of the walls of the shells 14 and 16, as shown in FIGS. 1 and 3.

The strips 42 seal the refractory layer 40 between the shells 14 and 16 except for two heat venting tubes 44 which pass through the strips 42 and project above the shells. The tubes 44 are open at the upper ends 45 located above the shells. Each tube 44 projects downward through the layer 40 and is bent inwardly so that the lower, horizontal tube portion 44*a* extends through a portion 40*a* of the layer between the bottom walls 26 and 36. The entire lengths of the tubes 44 are provided with holes 44*b* spaced approximately ¼ to ½ inch. The respective tube portions 44*a* can be joined, for example by a "T" fitting 46 as shown in FIG. 1, in order to improve distribution of heat vented from the bottom of the ladle. The tubes 44 provide venting of heat through the holes 44*b* from the refractory layer 40 to which the heat is conducted from the molten metal through either or both of the shells 14 and 16. Thus, when the ladle 10 is dipped into a bath of molten metal, heat is conducted through the exterior shell 16, as well as from the molten charge within the ladle through the interior shell 14 and vented from the layer 40 through tubes 44. Additional tubes can be provided in large ladles for venting higher generated heat.

Since the interior shell 14 is in contact with molten metal for a longer period of time than shell 16, the shell 14 can eventually develop a perforation after a long period of use. However, the refractory layer 40 insulates the outer shell 16 from a perforation burned in the interior shell 14. The perforation or rupture can be repaired easily with a welded patch at a convenient time. However, venting of heat through the tubes 44 retards development of such a perforation in either of the shells 14 and 16 and preserves the physical integrity of the refractory layer which will not distort under excessive heat stress.

Variation in the composition and structural components of the illustrated ladle may occur to the skilled artisan without departing from the scope of the appended claims. For example, in a small ladle in which the required heat venting is reduced, the venting tubes can extend only a short distance downward into the refractory layer between the upstanding walls of the ladle shells. Alternatively, a clearance space can be left above the top of the refractory layer between the upstanding walls of the shells, and the bottom end of the venting tube can open into the clearance space without projecting into the refractory layer, particularly when the required rate of heat dissipation is small. An additional vent tube can project forwardly from the spout and connect to the other vent tubes in order to induce additional air entry and circulation by the movement of the ladle. In a ladle having a large capacity, for example, 15 to 20 pounds or more of molten metal, the thermal insulation of the bottom of the ladle can be increased by including a layer of refractory material between the bottom wall of the outer shell and an addition wall or plate welded to the lower edges of the exterior side walls. The additional refractory layer can be vented by extending the vent tubes through holes provided in the bottom wall of the outer shell to connect branches from the tubes embedded in the additional refractory layer. The bottom of such modified ladle has a structure formed by three metal walls separated by two vented refractory layers which increase the useful life of both the interior and exterior bottom walls of the ladle. Similarly, three complete shells can be nested and separated by vented, refractory layers in order to further insulate both the sides and bottom of a large ladle in accordance with the invention.

I claim:

1. A submersible ladle for transporting and pouring metal comprising:

A. at least first and second one piece cup-shaped metal shells nested one within the other to form the respective interior and exterior retainer wall surfaces of the ladle and sealed to one another with sealing strips connecting the respective edges of said shells;

B. a vented refractory material layer sandwiched between at least portions of the shells to provide heat insulation therebetween;

C. said layer having at least one venting conduit for heat, said conduit extending into said layer and communicating with ambient atmosphere for accelerated transfer of heat conducted from said molten metal through said retaioner wall surfaces to ambient atmosphere thereby substantially decreasing degradation of said shells due to heat from said molten metal.

2. The ladle of claim 1 wherein each of said shells includes enclosure walls upstanding from a bottom wall and said layer extends substantially continuously between the enclosure and bottom walls, said ladle having a pouring spout spaced above said bottom walls.

3. The ladle of claim 1 wherein said conduit includes laterally extending apertures opening into said refractory layer.

4. The ladle of claim 2 wherein said venting conduit comprises at least one tube extending into said layer located between said respective bottom walls.

5. The ladle of claim 1 in which said venting conduit comprise tubes joined within a portion of said layer located between said respective bottom walls.

6. The ladle of claim 1 wherein said layer is a composition comprising fibrous alumino-silicate.

7. The ladle of claim 1 which includes a bracket for mounting the ladle to a ladler device for transporting and tilting same.

8. The ladle of claim 1 in which the venting conduit comprises a pair of venting tubes embedded in the refractory layer, said tubes each opening to ambient atmosphere at their upper ends and connected at their lower ends to a tubular member extending through the refractory layer across a bottom wall of the ladle.

9. The ladle of claim 2 further comprising a second refractory layer sandwiched between the bottom wall of said second shell and a third wall forming the bottom surface of the ladle.

10. The ladle of claim 9 wherein said second refractory layer includes venting conduit communicating with ambient atmosphere for additional heat transfer thereto.

* * * * *